United States Patent [19]

Cane

[11] 4,371,014

[45] Feb. 1, 1983

[54] APPARATUS FOR DOSING AND DISPENSING A PREDETERMINED VOLUME OF POWDERED MATERIAL

[75] Inventor: Alessandro Cane, Bologna, Italy

[73] Assignee: Zanasi Nigris S.p.A., Bologna, Italy

[21] Appl. No.: 202,660

[22] Filed: Oct. 31, 1980

[30] Foreign Application Priority Data

Oct. 31, 1979 [IT] Italy ..... 15300/79[U]

[51] Int. Cl.[3] ..... B67B 1/04

[52] U.S. Cl. ..... 141/91; 141/144; 222/636

[58] Field of Search ..... 222/366, 367, 368, 148, 222/636; 141/144, 91, 67; 198/491

[56] References Cited

U.S. PATENT DOCUMENTS

| | | | |
|---|---|---|---|
| 2,761,588 | 9/1956 | Shields | 222/148 |
| 3,154,117 | 10/1964 | Florin | 141/144 |
| 3,446,404 | 5/1969 | Mehta | 222/368 X |
| 3,677,383 | 7/1972 | Lamb | 198/491 X |
| 4,232,717 | 11/1980 | Allgaier et al. | 222/368 X |

*Primary Examiner*—Stanley H. Tollberg
*Attorney, Agent, or Firm*—Lowe, King, Price and Becker

[57] ABSTRACT

The apparatus for dosing and dispensing a predetermined volume of powdered material into containers sequentially moving the one after the other along a rectilinear path, comprises two rotary doser-dispenser units presenting a plurality of open-ended radial chambers which, upon rotation of the doser-dispenser units around a common rotational axis are sequentially inserted into the powdered material contained into a tank, suction being applied so that the chambers are filled with the powdered material, and thereafter are sequentially brought the one after the other into axial alignment with the receiving open end of the containers, pneumatic pressure being applied to discharge the powdered material from each chamber into the respectively aligned container. The common rotational axis of the two rotary doser-dispenser units is parallel to the rectilinear path along which the containers move.

6 Claims, 7 Drawing Figures

APPARATUS FOR DOSING AND DISPENSING A PREDETERMINED VOLUME OF POWDERED MATERIAL

BACKGROUND AND SUMMARY OF THE INVENTION

Automatic apparatuses are known for introducing dosed amounts of powder and/or particulate material, for example of medicinal preparations, into small bottles or other containers. Such apparatus typically include a conveyor for moving the bottles in single row and interceptor elements that will interfere with the flow of bottles so as to cyclically stop each bottle and position same for filling at a filling station and thereafter at a closure station.

When a doser-dispenser unit of known rotary type is used at the filling station, said unit usually rotates around a transverse axis which is perpendicular to the path of travel of the bottles. This type of operation entails the following drawbacks:

If the amount to be introduced into the bottles is, for example, double of the maximum single dose that said apparatus can supply, each bottle is usually stopped under said doser-dispenser unit during a period of time which is the double as that required to introduce one single dose, which obviously will reduce by half the production capacity of the apparatus; an attempt to overcome this drawback, for example by arranging successively a plurality of identical doser-dispenser units, or by replacing the said unit with another one having a higher dosing capacity, would entail constructional complications and higher operation costs.

The possibility that residues of material on the surfaces of the emptied chambers of the doser-dispenser unit (which rotates at relatively high speed), could be thrown by centrifugal force against the row of bottles and could soil their outer surface.

The above inconveniences are overcome, according to the present invention, by an improved automatic apparatus for forming and introducing dosed amounts of powdered or loose material into bottles or other containers. The apparatus of the invention comprises a plurality of doser-dispenser units disposed sequentially after each other and rotating about a common shaft which is parallel to the path of travel of said bottles so as to obtain an apparatus of simplified construction with higher operative capacity, and by avoiding centrifugal projections of said material onto the outer surface of the bottles.

The characterizing features of the apparatus according to the invention, and the advantages derived therefrom, will appear from the following description of a preferred embodiment, made with reference to the attached drawings.

DESCRIPTION OF A PREFERRED EMBODIMENT

Figure 1:
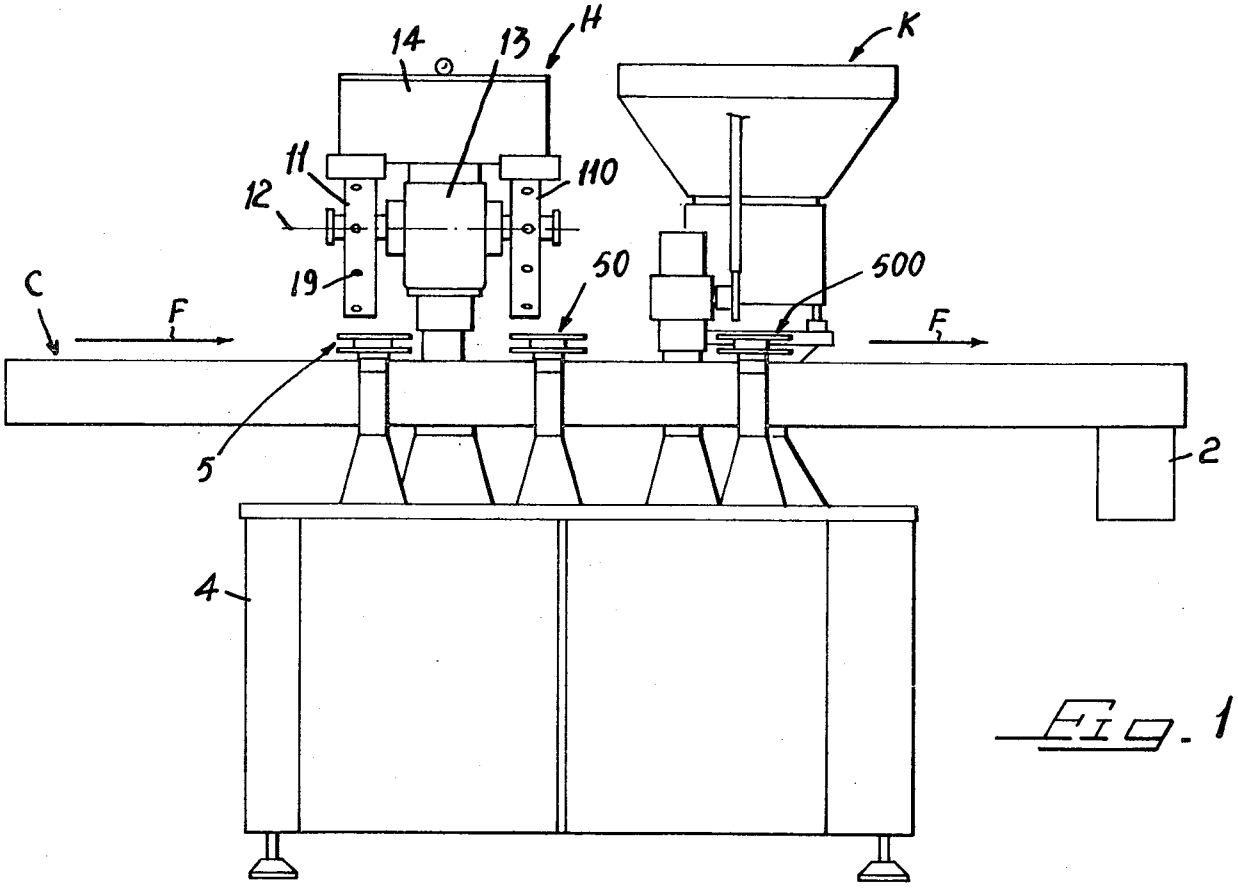
FIG. 1 is a side elevational view of the apparatus according to the invention.
Figure 2:
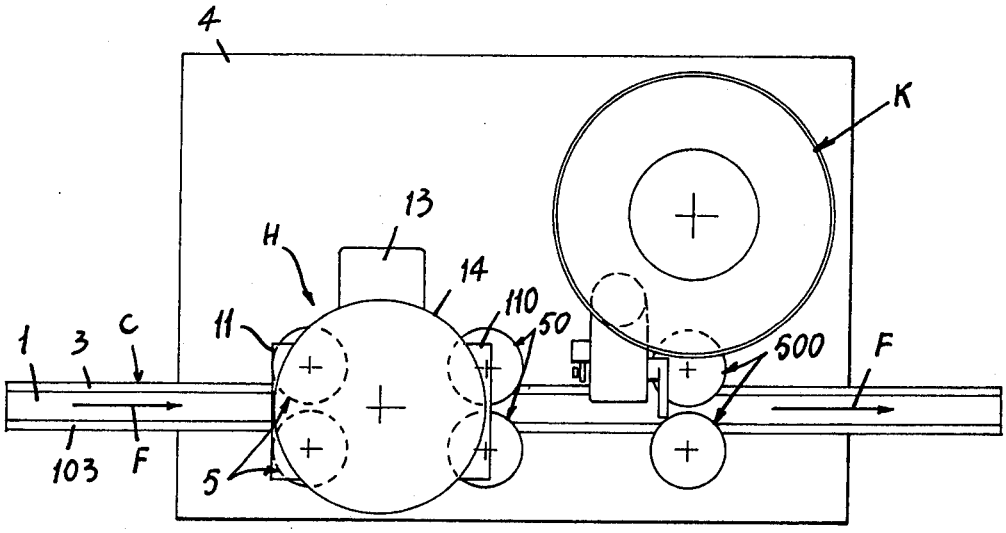
FIG. 2 is a plan view from the top of the apparatus of FIG. 1.
Figure 3:
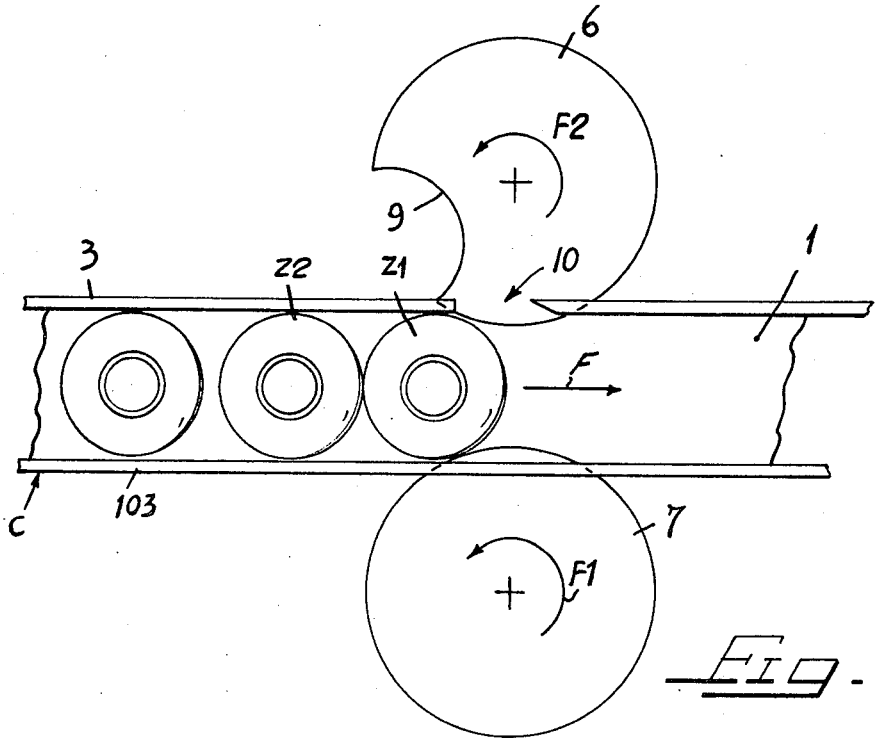
FIG. 3 is a top plan view of one of the interceptor elements for cyclically stopping and correctly positioning each bottle at each operative station of the apparatus.

With reference to FIGS. 1, 2 and 3, it will be noted that the apparatus comprises a horizontal, rectilinear conveyor channel C wherein the bottles are disposed vertically and are compelled to move in single row in the direction shown by the arrow F. The channel C comprises an endless belt conveyor 1 which is continuously moved by a driving motor 2, and is defined at both sides by longitudinal parallel guide members 3–103. The so-formed channel C is mounted on a cabinet frame 4 enclosing the main motor, various drives, the vacuum pump, compressor, filters, circuitry and other means which may be necessary for the automatic operation of the operative stations H and K of the apparatus.

The bottles Z will be cyclically stopped and correctly positioned, first at the station H for the introduction of the medicinal preparations and then at the closure station K, by means of interceptor elements 5 each comprising at least a pair of circular opposed discs 6–7 having a vertical rotational axis and partly interfering with said channel C so as to stop the flow of the bottles Z. The discs 6 and 7 can present either the same or of different diameters and rotate continuously as indicated, for example, by the arrows F1, F2. Said discs can be made of low friction material and/or can be machined so as to have a frictionless engagement with the side surface of the cyclically stopped bottles, or to engage them with an appropriate friction so that each bottom will be axially rotated thereby. In fact, such rotational movement can contribute the the success of certain operations at the stations H and/or K of the apparatus.

Still with reference to FIG. 3, it will be noted that one of the discs, for example the disc 6, is provided with at least a peripheral recess 9 of suitable size and shape, and that in front of the latter disc, said guide member 3 is provided with a longitudinal interruption 10. It is apparent that when the recess 9 enters the channel C, it permits the bottle Z1 to pass over the disc 7, whereas the next bottle Z2 will be stopped immediately.

Figures 4, 5, 6, 7:
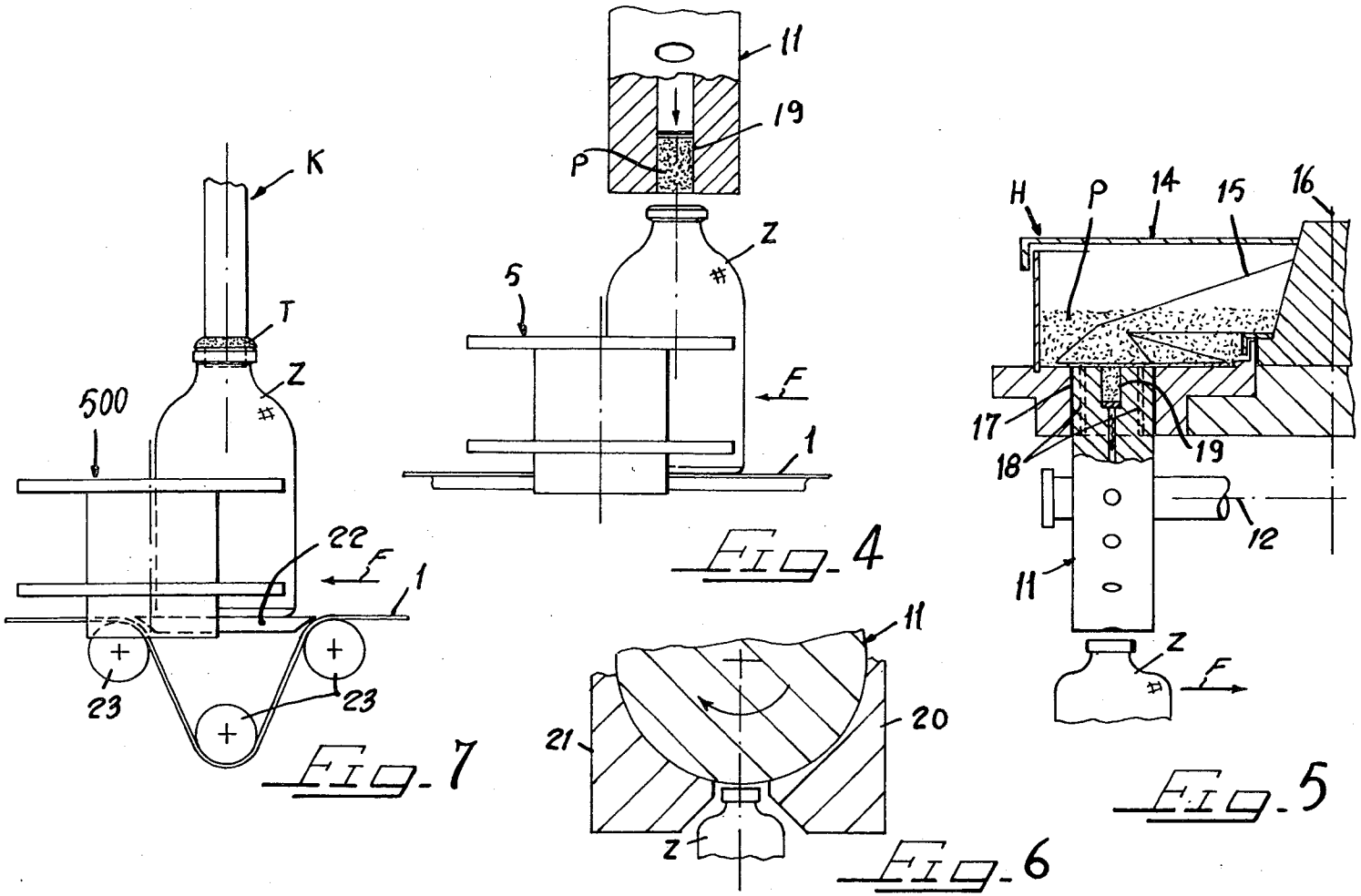
FIGS. 4 and 5 are side elevational and partly sectional views of two constructional details of the doser-dispenser unit at the station effecting the introduction of the dosed amounts into the bottles.
FIG. 6 is a diagrammatic front elevational and partly sectional view of further constructional details of a doser-dispenser unit.
FIG. 7 is a side elevational view of some elements of the station effecting the closure of the bottles.

To avoid any undesired oscillation of the bottles due to the action of the conveyor 1 or to an excessive height of said bottles the discs 6 and 7 are arranged, respectively, in coaxial suitably spaced pairs as shown in the FIGS. 1, 4 and 7.

The main novel characteristic of the improved apparatus according to this invention, resides in the fact that, at the filling or dispensing station H, one or more doser-dispenser units can be provided in cascade arrangement, as shown for example by reference numerals 11, 110, said units being mounted on the same shaft 12 which is parallel to the path of travel of the bottles Z and which lies on an imaginary vertical plane passing through the longitudinal center axis of said channel C. The drive for rotating the shaft 12 and all connections with the vacuum pump and compressor arranged in cabinet 4, are enclosed in the support frame 13 supporting a cylindrical container or tank 14 containing the material P to be dosed and introduced into the bottles Z. In the container 14, the material is stirred and is properly compacted by means of conventional stirring blades 15 rotating around a vertical shaft 16 which is also moved through a drive enclosed in said support frame 13.

As shown in FIG. 5, the doser-dispenser units 11–110 enter the container 14 through respective openings 17 in the bottom of said container, with interposed sealing gaskets 18. The operation of the doser-dispenser units is well known. During their stepwise rotation around the axis of shaft 12, these units present their open-ended radial chambers 19 to the interior of the container 14 while they are submitted to suction, so that an amount of material, proportional to the volume of said chambers 19 is sucked thereinto.

When the filled chambers, thereafter, have moved to a position above the respective bottles Z stopped at the station H by said interceptor elements 5–50, air at an appropriate pressure is blown through said chambers so as to discharge the dosed amounts of material into said bottles (FIG. 4).

The advantages resulting from said arrangement of the shaft of the doser-dispenser unit or units can be summarized as follows:

If more than one dosed amount is to be introduced into the bottles, a plurality of successively arranged doser-dispenser units (11, 110, etc.) are used so that the total time required to respectively add another dose to a bottle beneath one of the units is the same as that required for simultaneously adding one single dose to next in line bottle with another of said units. While in a conventional apparatus this procedure would entail very high production costs for the apparatus, this is not true for the apparatus according to the present invention, since all the units 11, 110 can be mounted on a single shaft 12 so as to utilize common mechanical and pneumatic actuators and can be supplied by a single filling container or tank 14.

The possible residues of powder material which might be left in the emptied chambers 19 of the doser-dispenser units will be thrown by centrifugal force in a transverse direction with respect to the path of travel of the bottles Z, so that the latter will not be soiled.

As diagrammatically shown in FIG. 6, inasmuch as the bottles move transversely with respect to the lateral surface of the units 11–110, said surface can be enclosed within a structure 20 which, for example, will present means for holding the material within the chambers 19, and in a subsequent casing 21 which, for example, will be provided with means for cleaning the chambers 19 by suction effect, immediately after they have been emptied.

Finally, it will be noted in FIGS. 1 and 2 that at the last station K, the bottles will be stopped by a further interceptor element 500 and will be closed by a plug T applied by means of conventional devices. However, it is to be understood that the station K can also be formed by a plurality of operative units if the bottles, for example, must be sealed also by capsules or other known means. In any case, the bottles which are stopped at the station K by the interceptor element 500 are supported in a fixed plane 22; underneath the same, the conveyor 1 is deviated by means of rollers 23. If desired, the plane 22 can be moved upwards and downwards whenever the bottle must be moved accordingly, for cooperation with the closure and sealing devices of the station K.

It is to be understood that all constructional details concerning the drive connections, pneumatic circuits and electrical circuits have been omitted from the above description, in consideration of the fact that they are not of basic importance for illustrating the invention and can be easily conceived and realized by any person skilled in the art.

I claim:

1. Apparatus for dosing and dispensing a predetermined volume of powdered material into containers moving sequentially along a rectilinear guide path, comprising supply tank means for containing said powdered material; a plurality of rotary doser-dispenser units mounted on a single shaft defining a common rotational axis of said units, said rotational axis being substantially parallel to the rectilinear path along which the containers move, each unit including a plurality of open-ended radial chambers being sequentially inserted into the powdered material contained in the supply tank means during rotation of each said unit about said rotational axis, suction means operatively connected to said chambers for filling the chambers with the powdered material, said chambers being further sequentially movable into axial alignment with a receiving open end of the containers, pneumatic pressure means being applied to said chamber for discharging the powdered material from each chamber into the respectively aligned container; conveyor means defining said rectilinear guide path for moving each said container into successive alignment with a chamber in at least two said units; and means for intercepting and stopping said container in successive alignment with the corresponding chamber of said units to thereby enable the powdered material in the chamber of said two units being discharged into the container to increase the dosage of material in the container.

2. An apparatus according to claim 1, wherein the rotational axis of the doser-dispenser units and the rectilinear path along which the containers move lie on a common, substantially vertical plane.

3. An apparatus according to claim 1, wherein said conveyor means includes a running endless support belt and of a pair of lateral fixed longitudinal guides defining a channel, said interceptor means operatively arranged in relation to the channel for stopping the containers in correspondence with the doser-dispenser units, thereby enabling the containers to receive said predetermined amount of powdered material.

4. An apparatus according to claim 3, wherein said interceptor means includes a pair of rotating co-planar discs having their rotational axis substantially perpendicular to the plane of the said endless support belt, said discs being arranged respectively at both sides of the channel along which the containers move and having circumferential edges projecting into said channel so as to stop the passage of the containers therethrough, one of said discs being provided with a circular recess having a depth substantially equal to the extent of the projection of the opposed disc into the channel, said lateral fixed longitudinal guide having an interruption on the side of the disc provided with the recess and in correspondence therewith.

5. Apparatus according to claim 1, further comprising means operatively positioned for retaining powdered material in the radial chambers during sequential movement of the chambers from the supply tank means into axially aligned position with the containers.

6. Apparatus according to claim 1 or 5, further comprising means operatively positioned for cleaning the chambers after powdered material is discharged from each chamber into respective containers, said means including suction means supplied to each chamber to thereby remove residual material from the chambers.

* * * * *